US006192947B1

(12) United States Patent
Ballan et al.

(10) Patent No.: US 6,192,947 B1
(45) Date of Patent: Feb. 27, 2001

(54) ROTARY FILLING MACHINE WITH INJECTION OF INERT GAS FOR FILLING CONTAINERS WITH LIQUIDS

(75) Inventors: Mauro Ballan; Remigio Boscaro, both of Verona; Pierluigi Allegro, Vicenza, all of (IT)

(73) Assignee: MBF S.p.A., Veronella (IT)

( * ) Notice: Subject to any disclaimer, the term of this patent is extended or adjusted under 35 U.S.C. 154(b) by 0 days.

(21) Appl. No.: 09/489,886

(22) Filed: Jan. 24, 2000

Related U.S. Application Data

(63) Continuation of application No. 09/097,641, filed on Jun. 16, 1998, now Pat. No. 6,079,460.

(30) Foreign Application Priority Data

Jun. 20, 1997 (IT) ..... VR97A0056

(51) Int. Cl.[7] ..... B65B 31/00
(52) U.S. Cl. ..... 141/49; 141/5
(58) Field of Search ..... 141/5, 6, 7, 44, 141/45, 46, 47, 48, 49, 50, 63, 145

(56) References Cited

U.S. PATENT DOCUMENTS 1,010,909 12/1911 Herd .
3,182,691 5/1965 Vergobbi et al. .
3,951,186 * 4/1976 Mencacci ..... 141/5
4,024,896 5/1977 Ishioka et al. .
4,207,932 6/1980 Gilmour .
5,082,033 1/1992 Weiss .
5,413,153 5/1995 Zwilling et al. .
5,634,500 * 6/1997 Clusserath et al. ..... 141/48

* cited by examiner

*Primary Examiner*—David J. Walczak
*Assistant Examiner*—Peter deVore
(74) *Attorney, Agent, or Firm*—Browdy And Neimark

(57) ABSTRACT

The present invention relates to a rotary filling machine with injection of inert gas for filling containers with liquids, comprising a rotating platform (2) provided peripherally with a plurality of filling valve assemblies (3), each of which is provided with a duct (4) for supplying the liquid from a storage tank (6) to a container (7) to be filled. Each valve assembly (3) comprises in particular a blow-in pipe (23) provided with an outlet mouth (60) connected to the bottom end of said duct (4), so as to introduce inert gas inside the container (7) in order to reduce the presence of oxygen which may be absorbed by part of the liquid during a step involving filling of the container (7).

5 Claims, 3 Drawing Sheets

ROTARY FILLING MACHINE WITH INJECTION OF INERT GAS FOR FILLING CONTAINERS WITH LIQUIDS

This is a continuation of copending parent application Ser. No. 09/097,641, filed Jun. 16, 1998, now U.S. Pat. No. 6,079,460.

BACKGROUND OF THE INVENTION

1. Field of the Invention

The present invention relates to a rotary filling machine with injection of inert gas for filling containers with liquids. The machine in question is intended to be used in bottling plants consisting of a rotating platform (or carousel) provided peripherally with a plurality of filling valve assemblies. More precisely, the machine in question is of the gravity or partial vacuum type and may be used optimally in the sector for the bottling of beverages such as wine, mineral water, etc.

2. Description of the Prior Art

As is known, in gravity or partial vacuum machines, a liquid (for example wine) is passed from a storage tank to a container (for example a bottle) by means of gravity or with the storage tank under a partial vacuum. According to the conventional technique, each filling valve assembly is provided with an obturator which regulates the supply of the liquid into the container arranged below the valve assembly itself.

The obturator of each valve assembly is mounted inside a tubular duct designed to connect the storage tank to the container.

The duct also has, mounted inside it, an air return pipe via which, during some steps of the machine filling cycle, gas or air is expelled from the container.

As is known, the filling machines are generally preceded, in the bottling process, by rinsing machines (with or without the insertion of inert gas) aimed at cleaning the containers and reducing as far as possible the presence of oxygen inside them.

This, because one of the main problems of the bottling process is to ensure preservation of the product, preventing in particular oxidation as far as possible. In fact, as is known, the organoleptic and qualitative characteristics of some food products (such as wine) alter significantly, even if subject to a slight degree of oxidation.

Some rinsing machines used nowadays remove the air from the bottles, replacing it with inert gas (usually nitrogen or carbon dioxide), after which the bottles continue on conveyors as far as filling machines such as those in question. During this travel movement, part of the inert gas present in the (open) bottles is dispersed and replaced with air. Moreover, once filling of the bottles has been completed, extraction of the liquid supply duct creates a slight vacuum with consequent drawing-in of outside air into the bottle.

Another type of filling machine of the known type (called isobaric) solves the problem of oxidation by removing, during a first step, of all the air from the bottle (creating a vacuum of the order of 80–90% inside it) and injecting inert gas under pressure during a next step, prior to filling. This type of machine, however, is very costly, has a low productivity and requires that the bottles be subjected to pressures which may risk breaking them.

The essential object of the present invention is therefore that of overcoming the drawbacks associated with the systems of the known type by providing a rotary filling machine which allows an inert gas to be inserted inside the containers before, during and at the end of the filling step so as to reduce significantly oxidation of the product to be inserted into the containers.

A further object of the present invention is that of providing a machine which is constructionally simple and operationally entirely reliable.

SUMMARY OF THE INVENTION

These objects, together with others, are all achieved by the filling machine in question, essentially comprising a blow-in pipe designed to introduce inert gas inside the container to be filled and provided with an outlet mouth connected to the bottom end of a liquid supply duct.

BRIEF DESCRIPTION OF THE DRAWINGS

The technical features of the invention, according to the aforementioned objects, may be clearly understood from the contents of the claims indicated below and the advantages thereof will emerge more clearly in the detailed description which follows, with reference to the accompanying drawings which illustrate a purely non-limiting example of embodiment thereof, in which:

DETAILED DESCRIPTION OF THE PREFERRED EMBODIMENTS

Figure 1:
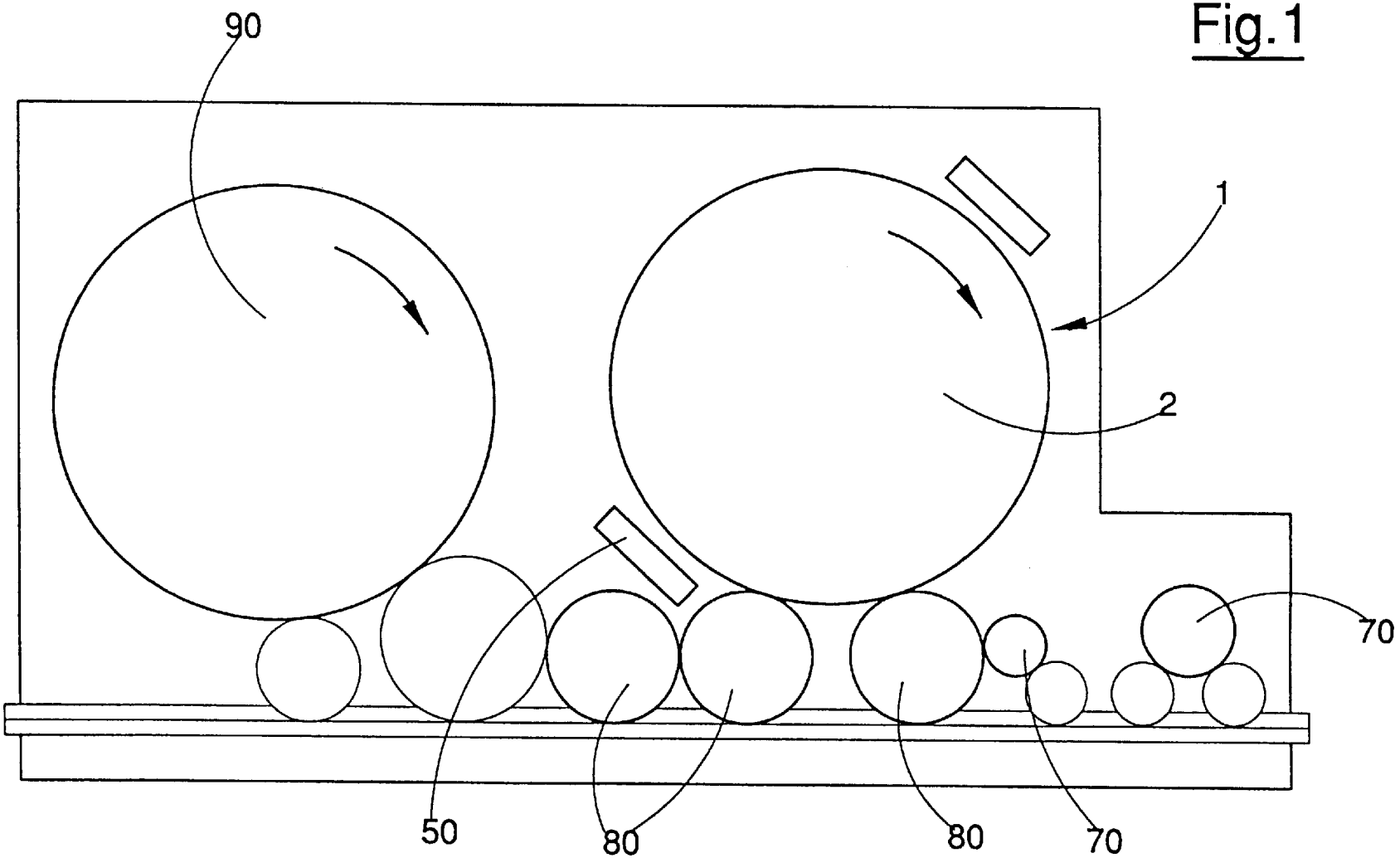
FIG. 1 shows a schematic view of a bottling plant incorporating the filling machine forming the subject of the present invention.

In accordance with the Figures of the accompanying drawings, 1 denotes in its entirety the rotary filling machine forming the subject of the present invention. Said machine is located (see FIG. 1), within a bottling plant, downstream of a rinsing machine 90 and upstream of sealing machines 70 and is operationally connected to the other abovementioned machines by conveyors 80.

The machine 1 in question comprises essentially a rotating platform 2 provided peripherally with a plurality of filling valve assemblies 3 (see FIG. 2), each of which is provided with a duct 4 intercepted by an obturator 5 for regulating the supply of liquid (for example wine) from an overhead storage tank 6 to an underlying container 7 to be filled (in the example illustrated, consisting of a bottle), and with an air return pipe 8 arranged, along a bottom section, inside the duct 4 and provided with an end section 9 for regulating hydraulically the maximum level of the liquid inside the container 7.

Each valve assembly 3 has, moreover, a centering cone 10 designed to receive in abutment the mouth of the container 7 and perform, with its raising movement, opening of the obturator 5 and the air return pipe 8, displacing upwards a movable sleeve 11 mounted externally around the duct 4.

Figure 2:
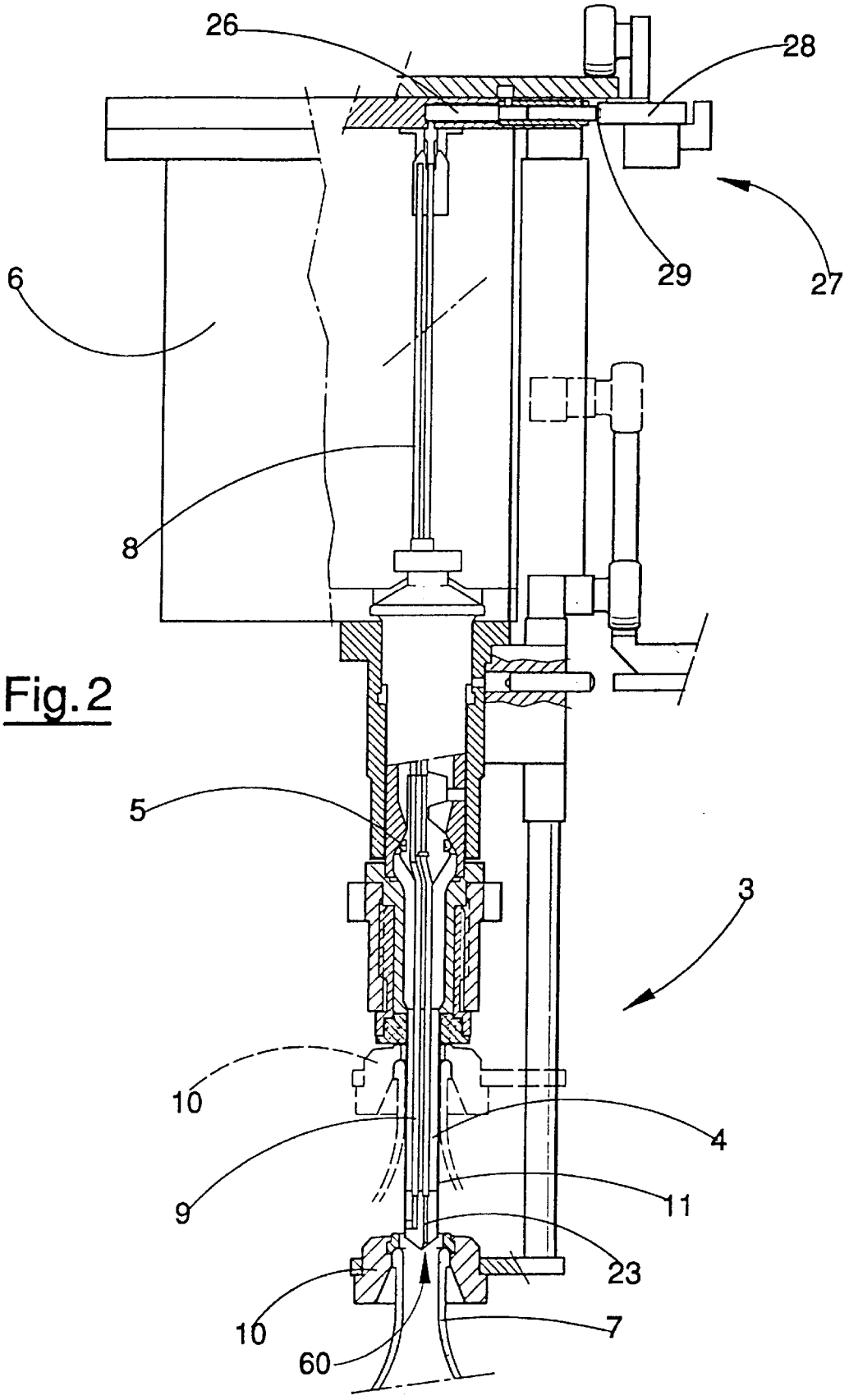
FIG. 2 shows a schematic sectional side view of an example of embodiment of a valve assembly of the filling machine in question.
Figure 2A:
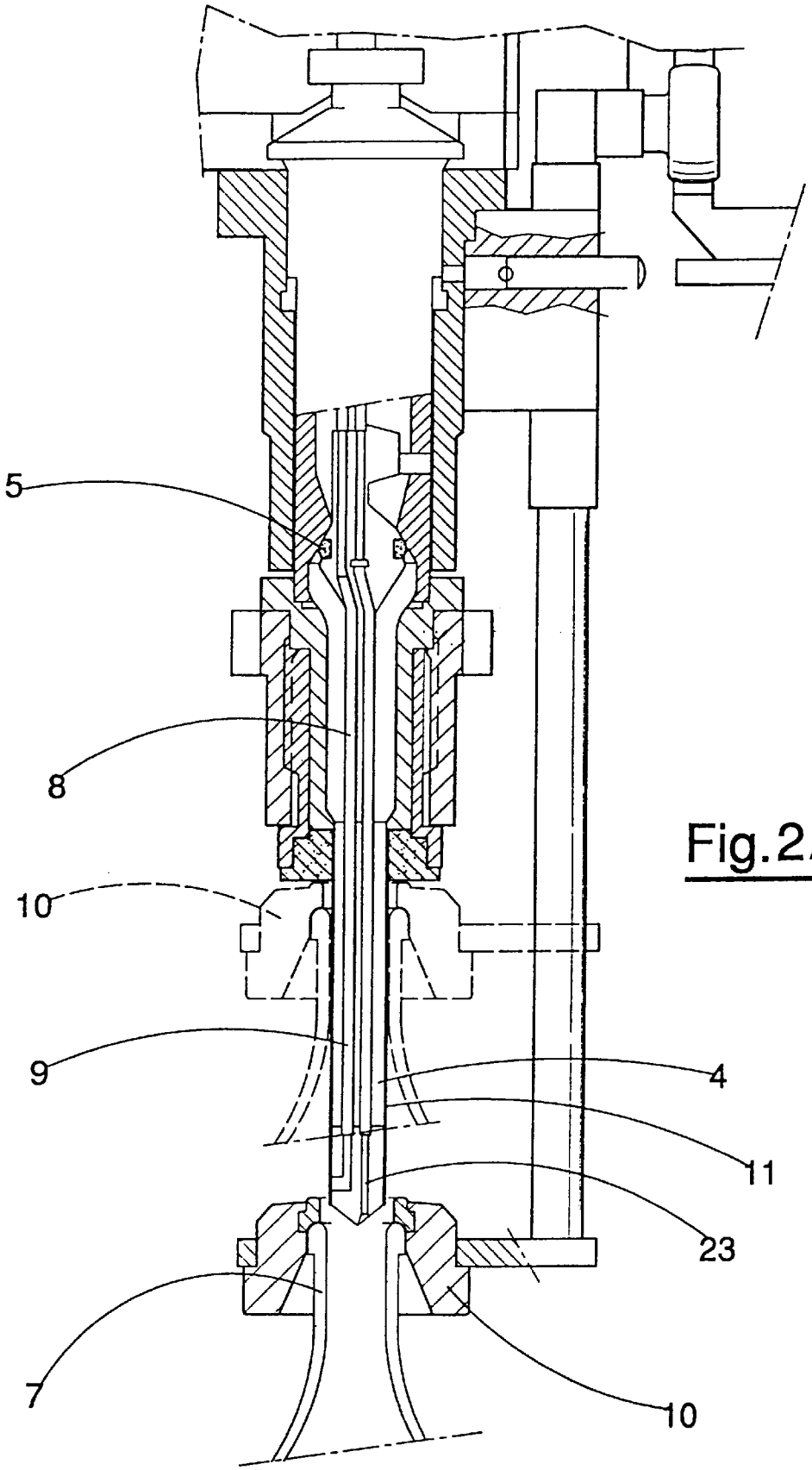
FIG. 2*a* shows a detail of FIG. 2 on a larger scale.

With reference to FIG. 2, each valve assembly 3 has, associated with it, a blow-in pipe 23 provided with an outlet mouth 60 connected to the bottom end of the duct 4 and designed to introduce inert gas into the container 7 in order to reduce the quantity of oxygen which would be absorbed by part of the liquid during a step where the container 7 itself is filled.

In the case of the example illustrated in FIG. 2, the blow-in pipe 23 is inserted inside the duct 4 parallel to the air return pipe 8.

Obviously the arrangement of the blow-in pipe 23 may be of any nature depending on the requirements, without, however, departing from the protective scope of the present invention.

The introduction of inert gas inside the container 7 by means of the abovementioned blow-in pipe 23 is performed in three different stages.

A first quantity of inert gas is introduced prior to the step of filling with the liquid in a step involving removal of the air from the container 7.

A second quantity of inert gas is introduced during the filling step in order to protect the laminar flow of the liquid which descends into the container 7 from the air/gas mixture which returns from the container 7 itself towards the air return pipe 8. The inert gas, in fact, lines with a thin veil the liquid descending into the container so as to prevent the return air/gas mixture from making contact with the liquid itself.

Finally, a third-quantity of inert gas is introduced at the end of the filling step during a step involving disengagement of the duct 4 from the container 7. In order to perform the abovementioned steps the blow-in pipe 23 is intercepted by a valve 26 actuated by actuator means 27 designed to regulate the supply of inert gas which passes through it.

The actuator means 27 comprise a third cam 28 which is mounted fixed with respect to the rotating platform 2 in a special blow-in station 50 and acts on a corresponding engaging element 29 connected to each valve 26 so as to perform opening and closing thereof in accordance with predetermined operating steps.

In this way, when, after rotation of the rotating platform 2, each valve assembly passes through the blow-in station 50, the cam 28 operates the individual engaging elements of the valve assemblies 3, thereby causing opening and closing of the corresponding valves 26.

Obviously the blow-in station and therefore the cam 28, mounted inside it, may be arranged in any position around the machine so as to allow the execution of the required steps for blowing-in of the inert gas, without thereby departing from the protective scope of the present patent.

What is claimed:

1. A rotary filling machine with injection of inert gas for filling containers with liquids, of the type consisting of a rotating platform (2) provided peripherally with a plurality of filling valve assemblies (3), each of which is provided with a duct (4) for supplying the liquid from a storage tank (6) to a container (7) to be filled with said liquid, wherein each valve assembly (3) comprises a blow-in pipe (23) provided with an outlet mouth (60) connected to the bottom end of said duct (4) and designed to introduce inert gas inside said container (7) in order to reduce the presence of oxygen which would be absorbed by part of the liquid during a step involving filling of said container (7), wherein, via said blow-in pipe (23), a second quantity of insert gas is introduced inside the container (7) during a compensation step aimed at protecting the laminar flow of the liquid which descends into the container (7) from the air/gas mixture which flows back out from the container (7) during said filling step.

2. The machine as claimed in claim 1, wherein said blow-in pipe (23) is mounted inside said liquid supply duct (4) and is intercepted by a valve (26) actuated by actuator means (27) designed to regulate the supply of inert gas which passes through it.

3. The machine as claimed in claim 2, wherein said actuator means (27) comprise at least one cam (28) which is fixed with respect to the rotating platform (2) in a special blow-in station (5) and designed to be combined, when said container (7) is arranged at the bottom of said valve assembly (3), with a corresponding engaging element (29) connected to each valve (26), the mutual contact between said engaging element (29) and said cam (28) causing opening and closing of said valve (26).

4. The machine as claimed in claim 1, wherein said blow-in pipe (23) is arranged inside said liquid supply duct (4).

5. The machine as claimed in claim 1, wherein said blow-in pipe (23) is provided in addition to an air return pipe (8).

* * * * *